US007104820B1

(12) United States Patent
Lu et al.

(10) Patent No.: US 7,104,820 B1
(45) Date of Patent: Sep. 12, 2006

(54) CARD CONNECTOR WITH RELIABLE SIGNAL TRANSMISSION

(75) Inventors: Chao Wang Lu, Tu-cheng (TW); Chang-Hsin Hsu, Tu-cheng (TW); Senbing Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/173,390

(22) Filed: Jun. 30, 2005

(51) Int. Cl.
*H01R 13/62* (2006.01)

(52) U.S. Cl. ..... 439/159; 439/607

(58) Field of Classification Search ..... 439/607, 439/609, 630, 108, 159
See application file for complete search history.

(56) References Cited

U.S. PATENT DOCUMENTS 5,662,558 A * 9/1997 Shannon, III ..... 482/55
6,095,830 A * 8/2000 Hirata et al. ..... 439/101
6,129,562 A * 10/2000 Hong ..... 439/79
6,206,730 B1 * 3/2001 Avery et al. ..... 439/609
6,478,591 B1 * 11/2002 Chang ..... 439/159
6,685,490 B1 * 2/2004 Xue et al. ..... 439/159

* cited by examiner

*Primary Examiner*—Gary R. Paumen
*Assistant Examiner*—Larisa Tsukerman
(74) *Attorney, Agent, or Firm*—Wei Te Chung

(57) ABSTRACT

A card connector includes an insulating housing (1), a number of contacts (2) and a shell (4). The insulating housing (1) defines a card receiving space (15) with a card insertion direction and comprises an engaging portion (114, 102). The contacts (2) are retained in the insulating housing (1) and exposed into the card receiving space (15). The shell (4) covered the insulating housing (1) comprises a resilient piece (411, 421) corresponding to the engaging portion (114, 102) of the insulating housing (1). The resilient piece (411, 421) of the shell (4) engages with the engaging portion (114, 102) of the insulating housing to urge the resilient piece to slightly distort elastically after the shell (4) is assembled to the insulating housing (1).

9 Claims, 5 Drawing Sheets

CARD CONNECTOR WITH RELIABLE SIGNAL TRANSMISSION

BACKGROUND OF THE INVENTION

1. Field of the Invention

The present invention is generally related to a card connector, and especially to a card connector which can be securely mounted on a Printed Circuit Board (PCB) to assure signal transmission.

2. Description of Related Art

Usually, consuming conducts, such as portable telephones, PDA (Personal Digital Assistance), digital cameras and the like, need electrical cards to enlarge and enhance functions thereof. Therefore, a plurality of card connectors adapted for receiving the corresponding cards are designed to accomplish requirements between the consuming products and the electrical cards. However, what is important is how to assure a secure signal transmission between the consuming products and the electrical cards with the aid of the card connectors.

U.S. Pat. No. 6,685,490 discloses a card connector which comprises an insulating housing, a plurality of contacts received in the insulating housing and a shell attaching to the insulating housing. The insulating housing is formed with protruding wedges and recesses on sidewalls thereof. The shell comprises mating holes and engaging pads corresponding to the protruding wedges and the recesses of the insulating housing. When the shell is assembled to the insulating housing, the protruding wedges of the insulating housing are received in the mating holes of the shell and the engaging pads of the shell are received in the recesses of the insulating housing. Then, the card connector is mounted on a PCB (Printed Circuit Board) in virtue of the shell soldered on the PCB.

However, cooperation of the insulating housing and the shell is not secure because the protruding wedges of the insulating housing and the engaging pads of the shell are commonly not tightly and securely received in the mating holes of the shell and the recesses of the housing, respectively. Therefore, with insertion times of a card inserting into the card connector increases, assembly between the shell and the insulating housing may become loose so that the electrical connection between the contacts and the PCB is affected. On the other hand, because assembly between the shell and the insulating housing is not tight enough, coplanarity is not assured when the card connector is mounted on the PCB in virtue of the shell soldering on the PCB. In such situation, it is bound to affect signal transmission between the card and the PCB.

Hence, an improved card connector is highly desired to overcome the aforementioned disadvantages of the prior art.

SUMMARY OF THE INVENTION

Accordingly, an object of the present invention is to provide a card connector which can be securely mounted on a Printed Circuit Board (PCB) to assure signal transmission.

To achieve the above abject, a card connector comprises an insulating housing, a number of contacts and a shell. The insulating housing defines a card receiving space with a card insertion direction and comprises an engaging portion. The contacts are retained in the insulating housing and are exposed into the card receiving space. The shell covered the insulating housing comprises at least a resilient piece corresponding to the engaging portion of the insulating housing. The resilient piece of the shell engages with the engaging portion of the insulating housing to urge the resilient piece to slightly distort elastically after the shell is assembled to the insulating housing.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Referring to FIGS. 1 to 5, the card connector in accordance with the present invention comprises an insulating housing 1, a plurality of contacts 2 received in the insulating housing 1, an ejector 3 and a shell 4 covering the insulating housing 1.

Figure 1:
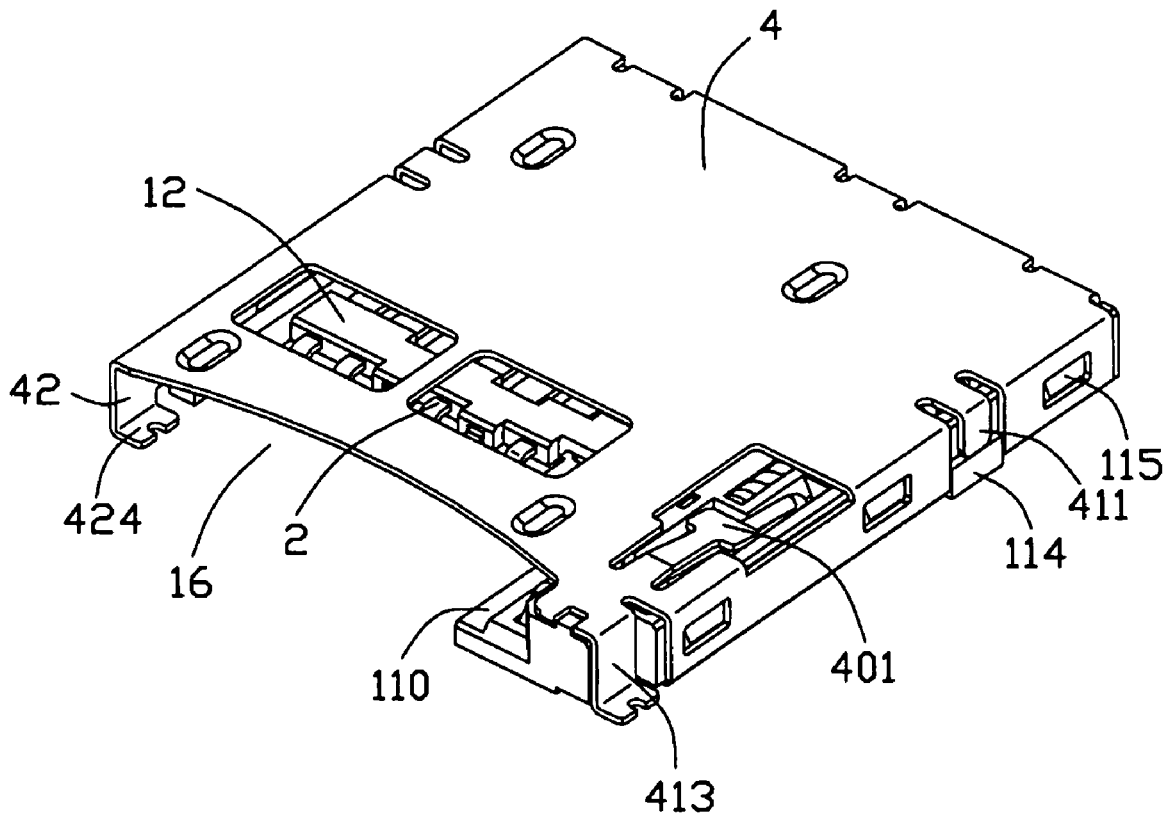
FIG. 1 is an assembled, perspective view of a card connector in accordance with the present invention.
Figure 2:
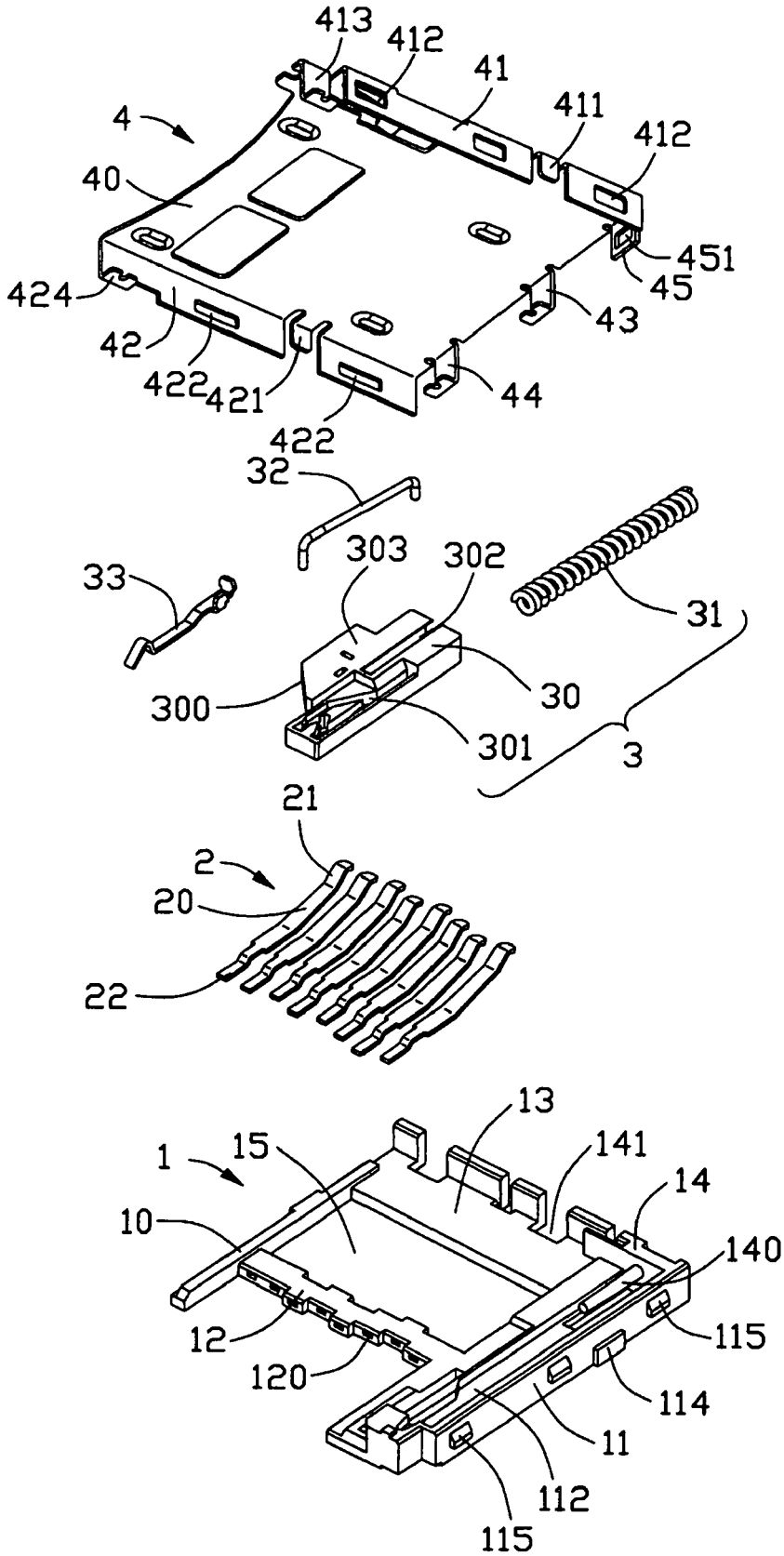
FIG. 2 is an exploded, perspective view of the card connector of FIG. 1.

Referring to FIGS. 1 and 2, the insulating housing 1 is approximately frame configuration. The insulating housing 1 comprises a head portion 13, a guiding arm 10 and a sidewall 11 both extending rearward from opposite lateral sides of the head portion 13, which commonly define a card receiving space 15 with a card inserting opening 16 recessed inwardly from a rear face of the insulating housing 1 to communicate with the card receiving space 15. The insulating housing 1 is provided with a transverse holding block 12 located adjacent to a rear end of the insulating housing 1 and exposed in the card receiving space 15 to connect the guiding arm 10 with the sidewall 11. The holding block 12 comprises a plurality of receiving holes 120 arranged along a transverse direction perpendicular to a card insertion/ejection direction for accommodating the contacts 2 therein.

Figure 3:
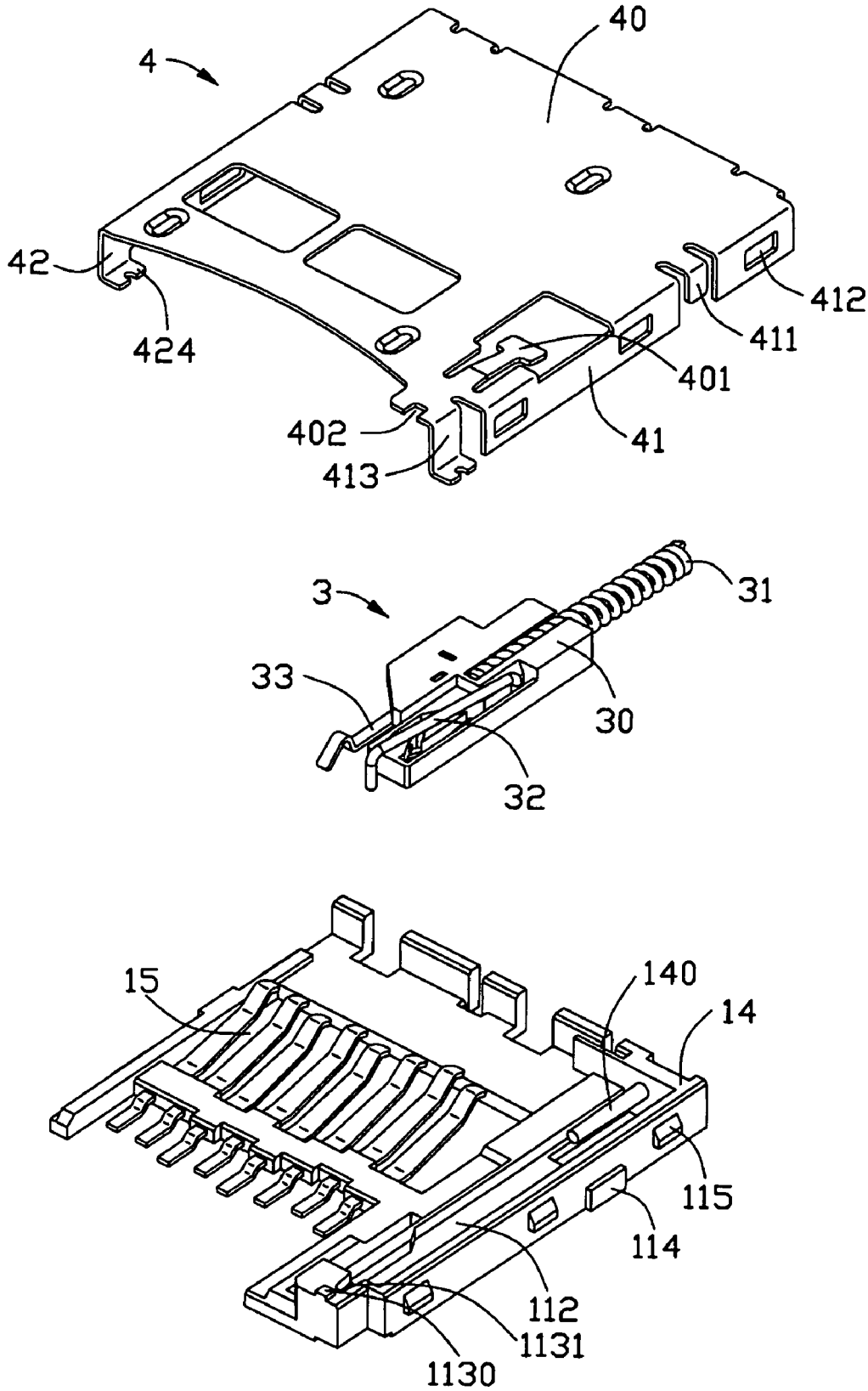
FIG. 3 is a partially assembled, perspective view of the card connector of FIG. 2.

Referring to FIGS. 1 to 3, the head portion 13 comprises a vertical wall 14 protruding upwardly from a front end thereof and extending along the transverse direction to end up the card receiving space 15. One end of the vertical wall 14 connects with the sidewall 11. The sidewall 11 is formed with a cavity 112 for receiving the ejector 3, a pinhole 1131, both recessed downwardly from a top face thereof, and a protruding portion 1130 disposed on the top face thereof. The cavity 112, the pinhole 1131 and the protruding portion 1130 are arranged approximately in alignment with one another along the card ejection direction. A column 140 protrudes rearward from the vertical wall 14 to expose into the cavity 112. Furthermore, the card connector is formed with a plurality of L-shaped cuts 141 disposed on the front end of head portion 13 through the vertical wall 14.

Each contact 2 is made of a metal sheet and comprises an intermediate portion 20 received in the receiving hole 120 of the holding block 12, a contacting portion 21 bent upwardly from the intermediate portion 20 to exposed into the card receiving space 15 and a surface mount type soldering portion 22 downward and rearward extending from the intermediate portion 20 to the rear face of the insulating housing 1. The width of the intermediate portion 20 is wider than that of the soldering portion 22.

Figure 4:
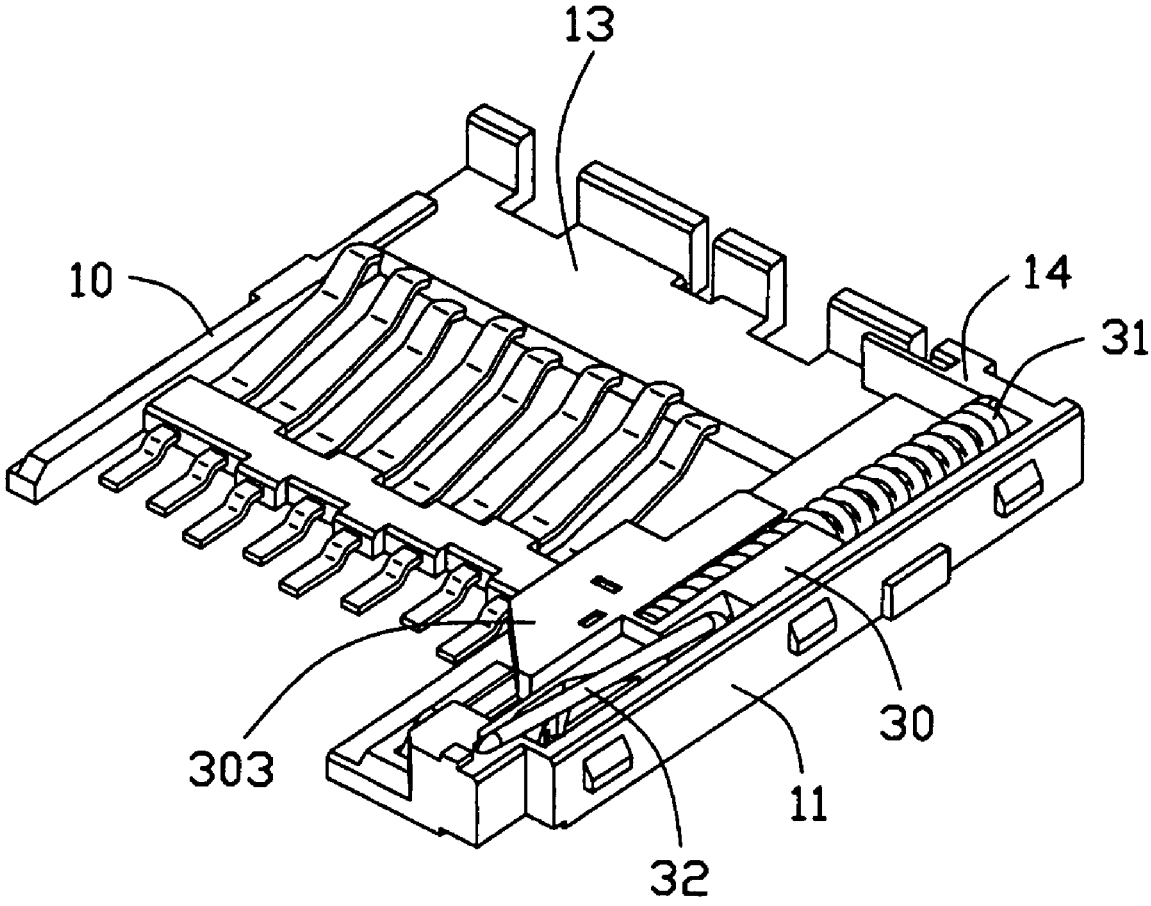
FIG. 4 is an assembled, perspective view of the card connector of FIG. 3, with a shell not illustrated.
Figure 5:
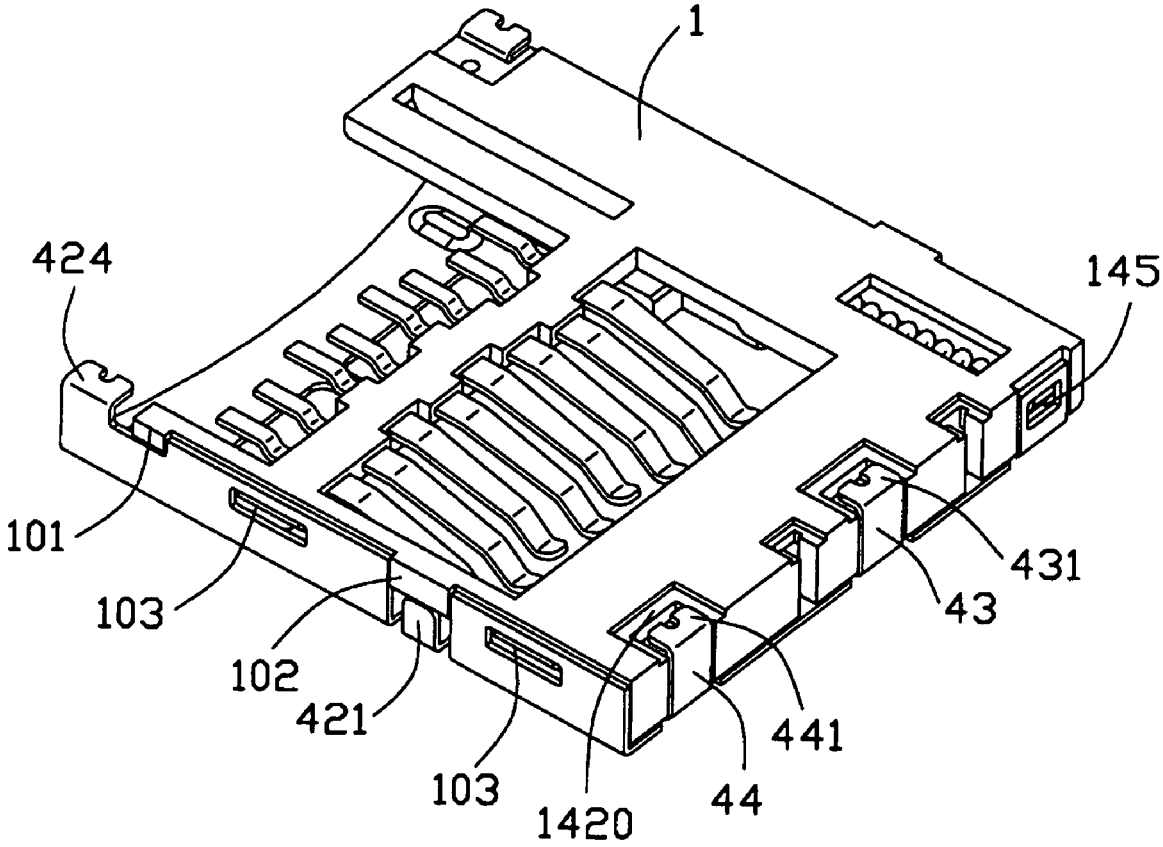
FIG. 5 is an assembled, perspective view similar to FIG. 1, but taken from another aspect.

Referring to FIGS. 2 to 4, the ejector 3 for ejecting a card comprises a slider 30 disposed in the cavity 112 of the sidewall 11, a spring 31, a pin member 32 and a locking member 33. The slider 30 can be moveable in the cavity 112 along the card insertion/ejection direction. An ejecting portion 303 protrudes into the card receiving space 15 from a top face of the slider 30 for ejecting the card and comprises a slanting ejecting face 300 formed on a rear end thereof. The slider 30 further comprises a hole 302 recessed rearward from a front face thereof to face to the column 140 of the vertical wall 14. One end of the spring 31 is received in the hole 302 and opposite end is disposed around the column 140. One end of the pin member 32 is moveably disposed in a hear-shaped slot 301 recessed downwardly from the top face of the slider 30. The other end of the pin member 32 is securely locked in the pinhole 1131 of the sidewall 11. One end of the locking member 33 locks in a bottom face of the slider 30 and opposite end protrudes into the card receiving space 15.

The shell 4 is made of metal sheet and comprises a flat base portion 40 and a pair of opposite side portions 41, 42 extending downward from opposite lateral sides of the base portion 40. The base portion 40 is provided with a pair of L-shaped mounting portions 43, 44 located in the corresponding cuts 141 of the insulating housing 1 and a holding portion 45 located adjacent to the side portion 41 along the transverse direction. The mounting portions 43, 44 and the holding portion 45 extend downward from a front end of the shell 4. A T-shaped resilient portion 401 is disposed in the base portion 40 adjacent to a rear end of the base portion 40 and the side portion 41. The holding portion 45 defines a rectangular hole 451 therein. The side portions 41, 42 are formed with a plurality of rectangular mating holes 412, 422 with different sizes and each defines a gap (not shown) to leave first and second resilient pieces 411, 421 extending from the base portion 40 in the gap of the shell 4, respectively. The first resilient piece 411 locates between a pair of first mating holes 412 of the side portion 41 adjacent to a front end of the shell 4. The second resilient piece 421 locates between the second mating holes 422 and faces to the first resilient piece 411. A pair of mounting feet 413, 424 are disposed on the rear ends of the side portions 41, 42, respectively.

Referring to FIGS. 1, 3, 4 and 5, the sidewall 11 of the insulating housing 1 further comprises a plurality of first wedges 115 and a first rectangular protrusion 114 served as an engaging portion, on outside of the sidewall 11 corresponding to the first mating holes 412 and the first resilient piece 411 of the shell 4, respectively. Furthermore, bottom faces of the protrusion 114 and the housing 1 are coplanar. A protruding block 145 is disposed on a front end of the vertical wall 14 adjacent to the sidewall 11 corresponding to the rectangular hole 451 of the shell 4. The guiding arm 10 also comprises a plurality of second wedges 103 and a second rectangular protrusion 102 on outside of the guiding arm 10 corresponding to the second mating holes 422 and the second resilient piece 421, respectively. The second rectangular protrusion 102 is arranged in alignment with the first rectangular protrusion 114 along the transverse direction and bottom faces of the second protrusion 102 and the housing 1 are also coplanar. The shell 4 is formed with a cutout 402 in the rear end thereof adjacent to the soldering foot 413 corresponding to the protruding portion 1130.

Referring to FIGS. 1 to 5, when the shell 4 is assembled to the insulating housing 1, the resilient portion 401 presses downward against the pin member 32 in the hear-shaped slot 301 of the ejector 3. The first wedges 115, the second wedges 103, the protruding block 145 and the protruding portion 1130 of the insulating housing 1 are respectively received in the first mating holes 412, the second mating holes 422, the rectangular hole 451 and the cutout 402 of the shell 4 to hold the shell 4 to cover the insulating housing 1. At the same time, in this embodiment, the first and second resilient pieces 411, 421 of the shell 4 engage tightly with the first and second rectangular protrusions 114, 102 of the insulating housing 1 respectively to urge the resilient pieces 411, 421 to produce elastic distortion because the height of the resilient piece 411 or 421 plus corresponding rectangular protrusion 114 or 102 is higher than that of the insulating housing 1. Certainly, it is not necessary that the height of the resilient piece 411 or 421 plus corresponding rectangular protrusion 114 or 102 is higher than that of the insulating housing 1 on condition that it can urge the resilient piece 411 or 421 to produce elastic distortion when the resilient piece 411 or 421 collides with the corresponding protrusion 114 or 102 respectively after the shell 4 assembles to the insulating housing 1. For example, distance between upper faces of the protrusions 114 or 102 and the insulating housing 1 is shorter than the height of the resilient piece 411 or 421. Therefore, because of the elastic distortion of the resilient pieces 411, 421, the shell 4 can mount tightly on the insulating housing 1.

On the other hand, because of the elastic distortion of the resilient pieces 411, 421 after the shell 4 assembled to the insulating housing 1, the shell 4 mount tightly on the insulating housing 1. In this situation, the mounting portions 43, 44 and the mounting feet 413, 424 of the shell 4 have secure coplanarity when they are soldered on the PCB. Therefore, the card connector can be soldered on the PCB securely with more rigid coplanarity.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulating housing defining a card receiving space with a card insertion direction and comprising an engaging portion with an upper face;

a plurality of contacts retained in the insulating housing and exposed into the card receiving space;

a shell assembled to the insulating housing and comprising a resilient piece corresponding to the engaging portion of the insulating housing; and the resilient piece of the shell engaging with the upper face of the engaging portion of the insulating housing to urge the resilient piece to slightly distort elastically after the shell is assembled to the insulating housing, wherein the engaging portion is a protrusion protruding from the insulating housing, wherein the resilient piece alignedly collides with the protrusion face to face, and wherein the height of the resilient piece plus the protrusion is higher than that of the insulating housing.

2. The card connector as described in claim 1, wherein bottom faces of the protrusion and the insulating housing are coplanar.

3. The card connector as described in claim 1, wherein the distance between upper faces of the protrusion and the insulating housing is shorter than the height of the resilient piece.

4. The card connector as described in claim 1, further comprising an ejector assembled in the insulating housing.

5. The card connector as described in claim 1, wherein the insulating housing comprises a head portion, a guiding arm and a sidewall both extending from opposite lateral sides of the head portion, and wherein the guiding arm and the sidewall of the insulating housing respectively form the engaging portion on out sides thereof.

6. The card connector as described in claim 5, wherein the insulating housing comprises a holding block exposed into the card receiving space to connect the guiding arm with the sidewall, and wherein the contacts are received in the holding block.

7. The card connector as described in claim 5, wherein the shell comprises a base portion and a pair of opposite side portions extending downward from the lateral sides of the base portion, and wherein the side portions define gaps for the corresponding resilient pieces to extend from the base portion, respectively.

8. The card connector as described in claim 7, wherein the guiding arm and the sidewall of the insulating housing comprise wedges, and wherein the side portions of the shell comprise mating holes receiving the wedges of the insulating housing.

9. The card connector as described in claim 8, wherein the engaging portion is located between two of the mating holes of the same side portion of the shell.

* * * * *